US007395872B2

(12) United States Patent
Duesselberg et al.

(10) Patent No.: US 7,395,872 B2
(45) Date of Patent: Jul. 8, 2008

(54) SWITCHING DEVICE

(75) Inventors: Achim Duesselberg, Hangzhou (CH); Andre Ullrich, Filderstadt-Bernhausen (DE)

(73) Assignee: Robert Bosch GmbH, Stuttgart (DE)

( * ) Notice: Subject to any disclaimer, the term of this patent is extended or adjusted under 35 U.S.C. 154(b) by 42 days.

(21) Appl. No.: 10/579,958

(22) PCT Filed: Jul. 6, 2005

(86) PCT No.: PCT/EP2005/053221

§ 371 (c)(1),
(2), (4) Date: May 19, 2006

(87) PCT Pub. No.: WO2006/029916

PCT Pub. Date: Mar. 23, 2006

(65) Prior Publication Data

US 2007/0102174 A1 May 10, 2007

(30) Foreign Application Priority Data

Sep. 17, 2004 (DE) ..... 10 2004 045 117

(51) Int. Cl.
*B25D 16/00* (2006.01)

(52) U.S. Cl. ..... 173/48; 173/109; 173/201

(58) Field of Classification Search ..... 173/48, 173/104, 109, 210, 211, 201
See application file for complete search history.

(56) References Cited

U.S. PATENT DOCUMENTS

| | | | | |
|---|---|---|---|---|
| 3,334,694 | A * | 8/1967 | Schnettler | 173/109 |
| 3,837,409 | A * | 9/1974 | Consoli et al. | 173/48 |
| 3,867,988 | A | 2/1975 | Koehler | |
| 4,158,970 | A * | 6/1979 | Laughon | 74/526 |
| 4,428,438 | A * | 1/1984 | Holzer | 173/48 |
| 4,998,588 | A * | 3/1991 | Manschitz | 173/47 |
| 5,337,835 | A * | 8/1994 | Bohne et al. | 173/13 |
| 5,366,025 | A * | 11/1994 | Dutschk et al. | 173/109 |
| 5,775,440 | A * | 7/1998 | Shinma | 173/109 |
| 5,842,527 | A * | 12/1998 | Arakawa et al. | 173/48 |
| 6,015,017 | A | 1/2000 | Lauterwald | |
| 6,109,364 | A * | 8/2000 | Demuth et al. | 173/48 |
| 6,176,321 | B1 * | 1/2001 | Arakawa et al. | 173/48 |
| 6,199,640 | B1 * | 3/2001 | Hecht | 173/48 |
| 6,520,267 | B2 * | 2/2003 | Fünfer et al. | 173/48 |
| 6,619,149 | B2 * | 9/2003 | Fünfer | 74/329 |
| 6,712,156 | B2 * | 3/2004 | Fünfer | 173/48 |
| 7,121,359 | B2 * | 10/2006 | Frauhammer et al. | 173/48 |
| 7,174,969 | B2 * | 2/2007 | Droste | 173/48 |
| 2005/0269116 | A1 | 12/2005 | Frauhammer et al. | |

FOREIGN PATENT DOCUMENTS

| | | |
|---|---|---|
| DE | 40 09 762 | 10/1991 |
| DE | 93 07 523 | 11/1994 |

(Continued)

*Primary Examiner*—Scott A. Smith
(74) *Attorney, Agent, or Firm*—Michael J. Striker

(57) ABSTRACT

The present invention is directed to a switching device with a rotatably mounted operating element (10) and an eccentric element (12) for translating a rotational displacement (14) of the operating element (10) into a translatory displacement (16) of a switching element (18), in particular a selector shaft of a hand-held power tool.

It is provided that a shape of the eccentric element (12) differs significantly from that of a rod.

8 Claims, 5 Drawing Sheets

FOREIGN PATENT DOCUMENTS

| | | |
|---|---|---|
| DE | 44 01 664 | 7/1995 |
| DE | 44 41 793 | 5/1996 |
| DE | 197 17 712 | 10/1998 |
| EP | 0 437 716 | 7/1991 |
| EP | 0 454 348 | 10/1991 |
| GB | 2 285 764 | 7/1995 |
| WO | 2004/060616 | 7/2004 |

* cited by examiner

SWITCHING DEVICE

BACKGROUND OF THE INVENTION

The present invention is directed to a switching device.

It is known to equip a hand-held power tool with a switching device that includes an operating element which is rotatably mounted on a housing of the hand-held power tool, and an eccentric element which is connected with the operating element. The eccentric element is directly or indirectly operatively connected with a switching piece or a switching plate which is axially rigidly connected with a switching element of the hand-held power tool. An indirect operative connection can be created using a leg spring, for example. By way of the eccentric element and the operative connection, a rotational displacement is translated, in a delayed manner, directly or by the leg spring into a translatory displacement of the switching element of the hand-held power tool, by way of which a profile of the switching element can be ultimately engaged with or disengaged from a complementary profile of a transmission of the hand-held power tool. As a result, certain functional units of the hand-held power tool, e.g., a striking mechanism and a rotary drive in the case of a rotary hammer, are coupled to or decoupled from a drive of the hand-held power tool.

SUMMARY OF THE INVENTION

The present invention is directed to a switching device with a rotatably mounted operating element and an eccentric element for translating a rotational displacement of the operating element into a translatory displacement of a switching element, in particular a selector shaft of a hand-held power tool.

It is provided that a shape of the eccentric element differs significantly from that of a rod. Since a dependency of the translatory displacement on a rotational displacement of the operating element is determined by the shape of the eccentric element, this dependency can be realized by selecting an appropriate shape, in a manner which appears reasonable to one skilled in the art. In particular, the extent of the dependency and/or sensitivity of the operating element can be determined—in a manner deemed suitable to one skilled in the art—such that it improves operating comfort depending on a switching position of the operating element.

In this context, the term "provided" should be understood to also mean "designed" and "equipped". In addition, an eccentric element is understood to be an element which is positioned eccentrically with respect to an axis of rotation of the operating element, the element preferably not also enclosing the axis of rotation with its convex sleeve. In addition, the term "rod-shaped" should be understood to mean a longitudinal shape, the length of which in the axial direction is greater than a width and/or a cross-sectional dimension, and/or the cross-sectional dimensions being smaller than an eccentricity of the eccentric element. A cross section of a rod-shaped element is convex. A deviation from a rod shape is understood to be "significant" when it is suitable for attaining a desired modification of a sinusoidal dependency—the sinusoidal dependency being produced by the rod shape—of the translatory displacement on the rotational displacement.

In an embodiment of the present invention it is provided that a cross section of the eccentric element differs significantly from a circular shape. As a result, a particularly advantageous variability of the dependency between translatory displacement and rotational displacement can be achieved.

An effective modulation of a natural—sinusoidal, in particular—dependency can be attained when a cross-sectional dimension of the eccentric element is in the order of magnitude of an eccentricity of the eccentric element. A "cross-sectional dimension" should be understood to mean a typical measure of length of the cross section, e.g., an extension in the circumferential direction or an extension in the radial direction with respect to an axis of rotation of the operating element. Two variables lie within one order of magnitude when they differ by less than a factor of 5 to 10.

It is further provided that the eccentric element has a guide surface provided to translate the rotational displacement via a contact point that travels on the guide surface during the rotational displacement. As a result, a particularly reliable determination of the dependency can be attained. A tilting between movably mounted elements can be reliably prevented, and wear can be kept advantageously to a minimum. The contact point is a point of contact of the eccentric element with a further element that is advantageously operatively connected with the switching element. Particularly advantageously, a synchronizing spring of a hand-held power tool transmission can bear against the contact point.

In a further embodiment of the present invention it is provided that the guide surface is configured in accordance with a predetermined dependency between an angle of rotation of the operating element and an eccentricity of the contact point. As a result, this dependency can be realized using simple design means.

It is further provided that the guide surface is designed significantly parabolic in shape. As a result, an advantageously antisymmetrical course of the dependency can be attained and, in fact, particularly when a vertex of the parabola points outwardly in the radial direction. When the contact point moves in the region of the vertex of the parabola, an at least considerable independence of the position of the switching element from a rotary position of the operating element can be attained, by way of which an advantageous tolerance insensitivity can be attained in this region.

When the eccentric element has at least two guide surfaces, it can be advantageously attained that one rotational displacement of the operating element induces two displacements of further switching elements in a well-determined manner. Embodiments of the present invention in which the guide surfaces determine a displacement of springs of a two-legged spring are particularly advantageous. When the spring is rotatably mounted, in particular, it is possible to determine a position and preload of the two-legged spring advantageously independently of each other.

If an eccentricity of the contact point varies during a switching motion by at least 10%, a highly noticeable improvement in operator comfort can be attained, it being possible for this improved comfort to be even more pronounced when the eccentricity of the contact point varies by at least 50% during a switching motion.

A more cost effective and reliable synchronizing mechanism for a hand-held power tool transmission can be attained when the switching device includes a two-legged shift spring. It is advantageously possible to determine two configuration parameters, e.g., a rotational position and a preload on the two-legged shift spring, independently of each other in order to optimize the course of the switching motion when, in at least one operating configuration, the shift spring contacts the eccentric element at two contact points, it being possible to ensure an advantageous absence of play when, in at least one operating configuration, the shift spring is preloaded by the eccentric element.

BRIEF DESCRIPTION OF THE DRAWINGS

Further advantages result from the description of the drawing, below. An exemplary embodiment of the present invention is shown in the drawing. The drawing, the description and the claims contain numerous features in combination. One skilled in the art will also advantageously consider the features individually and combine them to form further reasonable combinations.

DETAILED DESCRIPTION OF THE EXEMPLARY EMBODIMENT

Figure 1:
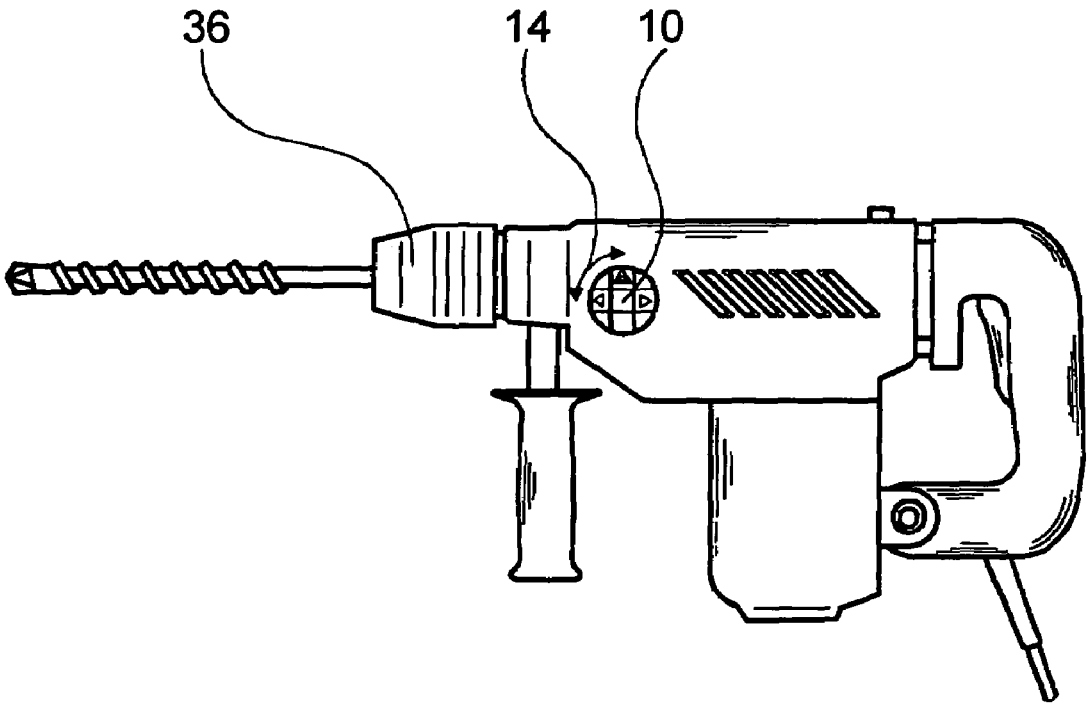
FIG. 1 shows a hand-held power tool with an operating element.

FIG. 1 shows a hand-held power tool, designed as a rotary hammer, with an operating element 10 mounted on a housing of the hand-held power tool. The hand-held power tool includes an electric motor and a transmission with a switching element 18, which can be switched by an operator with the aid of operating element 10 into one of three operating modes. In a drilling mode, the electric motor drives a tool fitting 36 in a rotational manner via the transmission. In an impact drilling mode, the electric motor also drives a striking mechanism 38. In a chiseling mode, the rotary drive of tool fitting 36 is decoupled from the electric motor, and the electric motor only drives striking mechanism 38.

Striking mechanism 38 includes a beatpiece (not shown here) and a piston which, during operation, is displaced in a hammer tube in a periodic manner via a wobble bearing 40 with a wobble finger 42.

Figure 2:
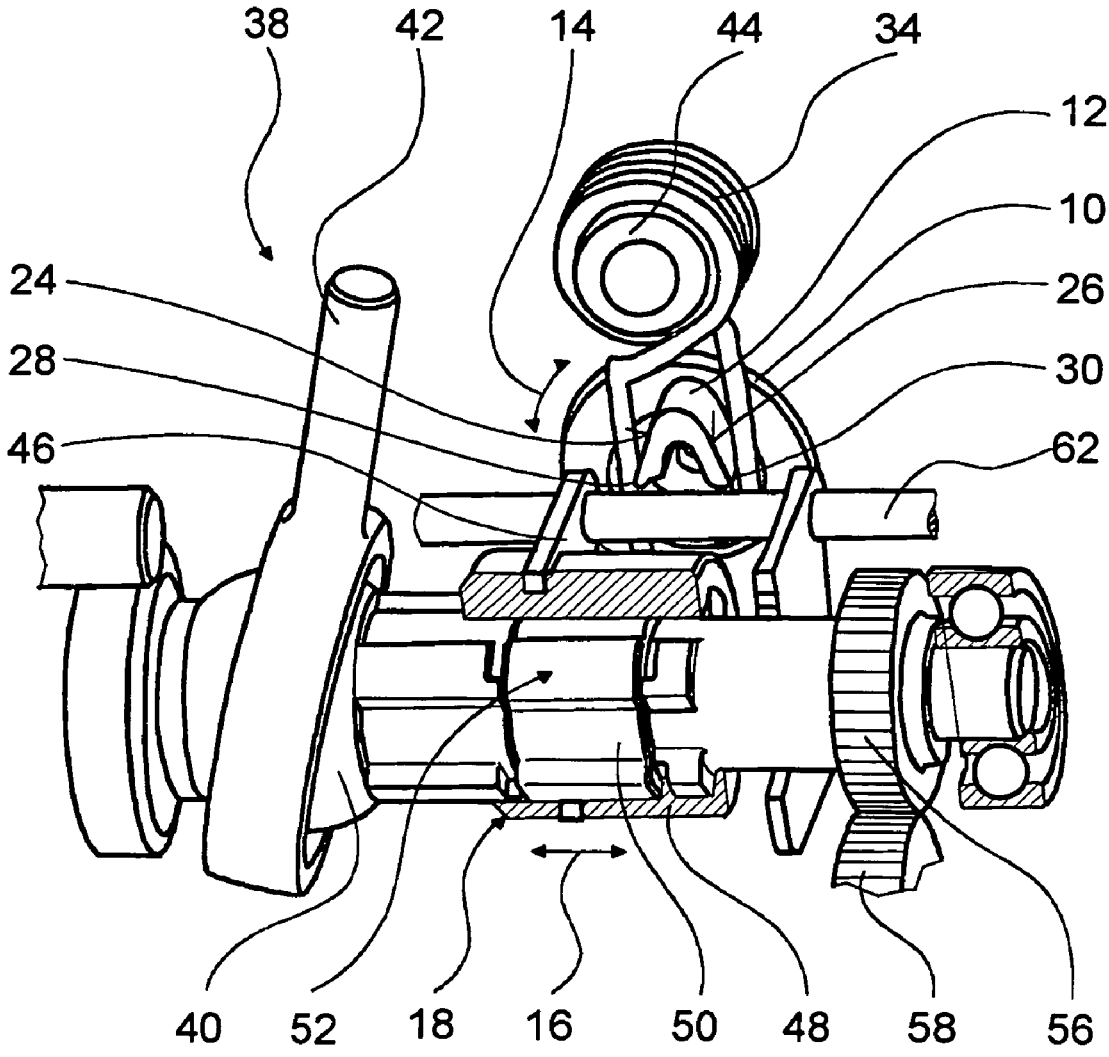
FIG. 2 shows a switching device of the hand-held power tool in FIG. 1.

Operating element 10 is rotatably mounted on the housing of the hand-held power tool via a circumferential groove (FIG. 2) and includes a gripper bar on its side that extends beyond an exterior side of the housing. On a side extending into an interior space of the housing and/or the hand-held power tool, operating element 10 includes a parabolic and/or U-shaped eccentric element 12, the vertex of which points radially outwardly. The parabolic cross section of eccentric element 12 does not change across a depth of eccentric element 12, which extends in the axial direction relative to an axis of rotation of operating element 10. The axis of rotation is located entirely outside of eccentric element 12. Operating element 10 is designed as an injection-moulded part, and eccentric element 12 is integrally moulded on operating element 10.

Lateral surfaces that bound eccentric element 12 in the radial direction and in the circumferential direction form guide surfaces 24, 26 for guiding a two-legged shift spring 34.

By way of an eyelet-shaped spiral spring, shift spring 34 is inserted onto a bolt 44 integrally moulded on the housing of the hand-held power tool and extending inwardly, and, after overcoming a slight amount of friction, is rotatably mounted on bolt 44. Shift spring 34 includes two legs which bear against two substantially diametrically opposed points on eccentric element 12. A first leg bears against a contact point 28 on guide surface 24, and a second leg bears against a contact point 30 on guide surface 26. A cross-sectional dimension 20 and/or a distance between contact points 28, 30 is greater than a distance between the two legs of shift spring 34 in a neutral configuration of shift spring 34, thereby ensuring that shift spring 34 is preloaded by eccentric element 12 inserted between the legs.

When an operator rotates operating element 10, contact points 28, 30 move on guide surfaces 24, 26, shift spring 34 rotating on bolt 44 to reach a state of minimum energy. During the displacement, the distance between contact points 28, 30 changes in a manner determined by the shape of guide surfaces 24, 26, while the preload on shift spring 34 varies simultaneously.

Free ends of shift spring 34 grip a switching plate 46 which engages in a circumferential groove of a shift sleeve 48. Switching plate 46 is guided in the axial direction on a guide rod 62 extending parallel to a drive shaft 52. Shift sleeve 48 is inserted onto a widened region 50 of a drive shaft 52, and is mounted via an inner profile and an outer profile of region 50 such that it is non-rotatable but axially displaceble relative to an axis of rotation of drive shaft 52 which extends perpendicularly to the axis of rotation of operating element 10.

Wobble bearing 40 is inserted onto the drive shaft on a first side of region 50, wobble bearing 50 including a sleeve-shaped projection with an outer profile on the side facing region 50, sleeve-shaped projection corresponding to inner profile of shift sleeve 48. On an inner surface, wobble bearing 40 includes needle roller bearings 54, 54', via which wobble bearing 40 is rotatably mounted on drive shaft 52.

When shift sleeve 48 is displaced in the direction of wobble bearing 40—and when the rotational position of the profiles match—shift sleeve 48 moves over the outer profile of wobble bearing 40 and, as a result, it establishes a non-rotatable connection between wobble bearing 40 and its sleeve-shaped projection and region 50 of drive shaft 52. A rotational displacement of drive shaft 52 is then transferred to wobble bearing 40 and, via wobble finger 42, to the piston and beatpiece of striking mechanism 38 of the hand-held power tool.

On a second side of region 50, a gearwheel 56 is inserted onto drive shaft 52, gearwheel 56 engaging in a corresponding gearwheel 58. Gearwheel 58 is operatively connected with tool fitting 36. Gearwheel 58 includes a sleeve-shaped projection extending in the direction of region 50, sleeve-shaped projection including an outer profile that corresponds to an inner profile of shift sleeve 48. On an inner surface, gearwheel 56 includes needle roller bearings 54, 54', via which gearwheel 56 is rotatably mounted on drive shaft 52.

Similar to wobble bearing 40, gearwheel 56 can be non-rotatably connected with drive shaft 52 and/or region 50 by displacing shift sleeve 48 in the direction of sleeve-shaped projection of gearwheel 56. As a result, a rotational displacement of drive shaft 52 is transferred to gearwheel 56 and, from here, to gearwheel 58 and tool fitting 36, by way of which a rotational drive of tool fitting 36 is activated.

The switching device includes a total of three switching settings. In a middle switching setting, shift sleeve 48 is engaged with gearwheel 56, region 50 and wobble bearing 40, and a striking mechanism 38 is thereby activated. The hand-held power tool is then switched to an impact drilling mode.

In a second position—starting from the central position and being displaced in the direction of wobble bearing 40—shift sleeve 48 is engaged with central region 50 and wobble bearing 40, while the outer profile of gearwheel 56 is free. As a result, striking mechanism 38 is activated, and a rotational drive of tool fitting 36 is decoupled. Hand-held power tool is then in a chiseling mode. Embodiments of the present invention are feasible in which a rotational position of tool fitting 36 is locked when shift sleeve 48 is displaced from the central position into the position in the direction of wobble bearing 40.

In a third position—starting from the central position and being displaced in the direction of gearwheel 56—shift sleeve 48 is engaged with central region 50 and gearwheel 56, while the outer profile of wobble bearing 40 is free. As a result, the rotational drive of tool fitting 36 is activated, and striking mechanism 38 is decoupled. Hand-held power tool is then in a drilling mode.

When an operator—starting from the central position of shift sleeve 48, with a gripper bar extending perpendicularly to the axis of rotation of the drive shaft—rotates operating element 10 in a rotary motion 14 by 90° in the clockwise direction, eccentric element 12 rotates simultaneously, and, in fact, it rotates simultaneously in the direction of gearwheel 56 due to its eccentric position relative to the axis of rotation of operating element 10. As a result of the force transmitted by the second leg via contact point 30, shift spring 34 pivots in the direction opposite to the direction of rotation of operating element 10, and the free end of the first leg exerts a force on shift plate 46 and shift sleeve 48, which is displaced in the direction of gearwheel 56. Shift sleeve 48 slides off of the sleeve-shaped projection of wobble bearing 40 and, as a result, decouples striking mechanism 38 from drive shaft 52. Eccentric element 12 therefore translates rotational displacement 14 of operating element 10 into a translatory displacement 16 of switching element 18.

When—starting from the third position and with the gripper bar oriented parallel to drive shaft 52—the operator rotates operating element 10 in a rotary motion 14 by 90° in the counterclockwise direction, a free end of the second leg of shift spring 34 displaces switching element 18 in the direction of wobble bearing 40 until a front side of the inner profile of shift sleeve 48 comes to bear against a front side of the outer profile of the sleeve-shaped projection of wobble bearing 40. A further rotation of operating element 10 in the clockwise direction causes the second leg to detach from contact point 28 on guide surface 26 of eccentric element 12 and results in increased preload on shift spring 34. If drive shaft 52 is rotated by the electric motor or via shaking, the inner profile and outer profile can slide into each other, so that shift sleeve 48 is moved via the spring force into the first, central position and therefore brings the hand-held power tool into the impact drilling mode and decouples striking mechanism 38 from the drive.

The process of turning the rotational drive of tool fitting 36 on and off takes place in a manner that is a mirror image of the process of switching striking mechanism 38 on and off described above. When, starting from the central position, the operator rotates operating element 10 in a rotary motion 16 by 90° in the counterclockwise direction, shift sleeve 48 of switching element 18 is displaced in the direction of wobble bearing 40 and thereby slides off of the sleeve-shaped projection on gearwheel 56, thereby decoupling the rotational drive from drive shaft 52. When the operator rotates operating element 10 back in the direction of the central position, the front sides of the inner profile of shift sleeve 48 and the outer profile of the sleeve-shaped projection of gearwheel 56 come to rest until, via rotation, the inner profile and the outer profile become synchromeshed and can slide into each other.

Figure 5:
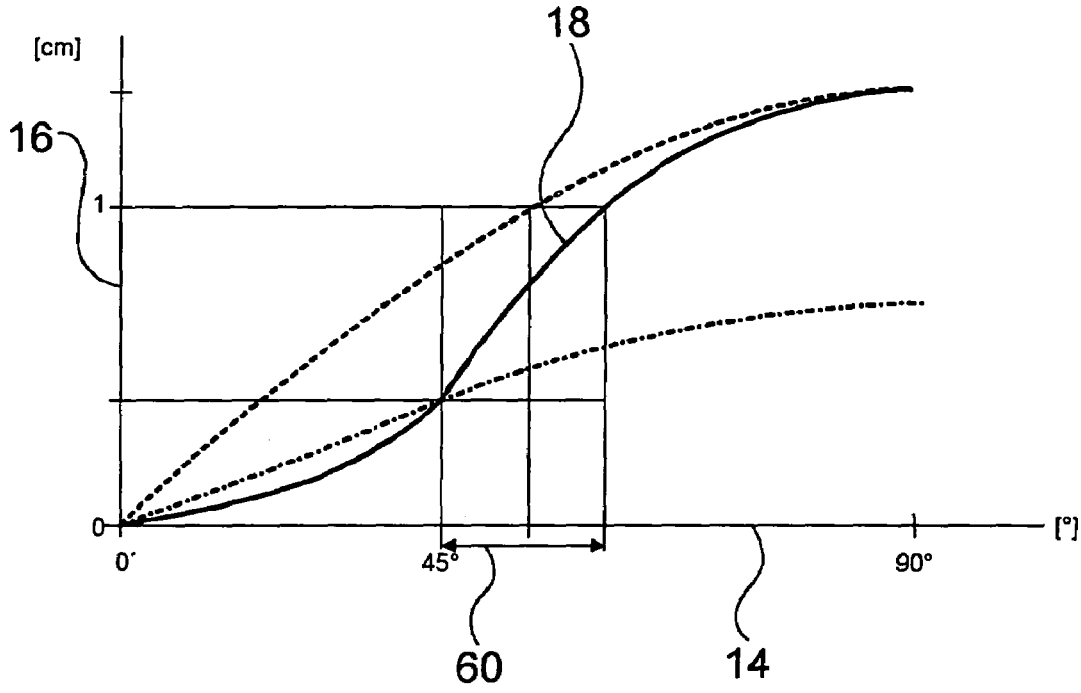
FIG. 5 shows a graph of the dependence of a position of the switching element and a rotational position of the operating element in FIGS. 1 through 4.

FIG. 5 shows the course of translatory displacement 16 as a function of an angle of rotation 32 of operating element 10 in an angular range between 0° and 90°, angle 0° being assigned to the first rotational position with a gripper bar extending perpendicularly to the axis of rotation of drive shaft 52.

During a rotary displacement 14 from 0° to 90°, contact point 30 slides over guide surface 26, and an eccentricity 22 of contact point 30 and/or a distance between contact point 30 and the axis of rotation of operating element 10 doubles. In rotational angle 32 of the first position, eccentricity 22 is equal to the distance between the two outermost ends of the legs of eccentric element 12. This distance is equal to the length of the two legs of eccentric element 12. The distance is a typical cross-sectional dimension 20 of eccentric element 12. Simultaneously, during rotational displacement 14 from 0° to 90°, an angle between the gripper bar of operating element 10 and contact point 30 is displaced by approx. 45°. During rotational displacement 14 from 0° to 90°, contact point 28 remains in a substantially constant position at the end of guide surface 24, which forms an edge around which the first leg of shift spring 34 rotates.

An increase in translatory displacement 16 shown in the graph in FIG. 5 reaches a maximum in a switching region 60 in which the front sides of the profiles of shift sleeve 48 and wobble bearing 40 and/or gearwheel 56 come to rest. As a result, an operator can control translatory displacement 16 using operating element 10 particularly effectively in this range.

Courses of the translatory displacement are also indicated with dashed lines in FIG. 5. These courses would be generated by rod-shaped eccentric elements that are located either in the position of contact point 30 with rotational position of 0°, or in the position of contact point 30 with a rotational position of 90°.

Compared with a translatory displacement 16 produced by eccentric element 12, the course in the region of rotational angle 32 of 0° is very flat. As a result, the switching device is characterized by an advantageous lack of sensitivity to unexact settings of angular position 32 by the operator.

Figure 3:
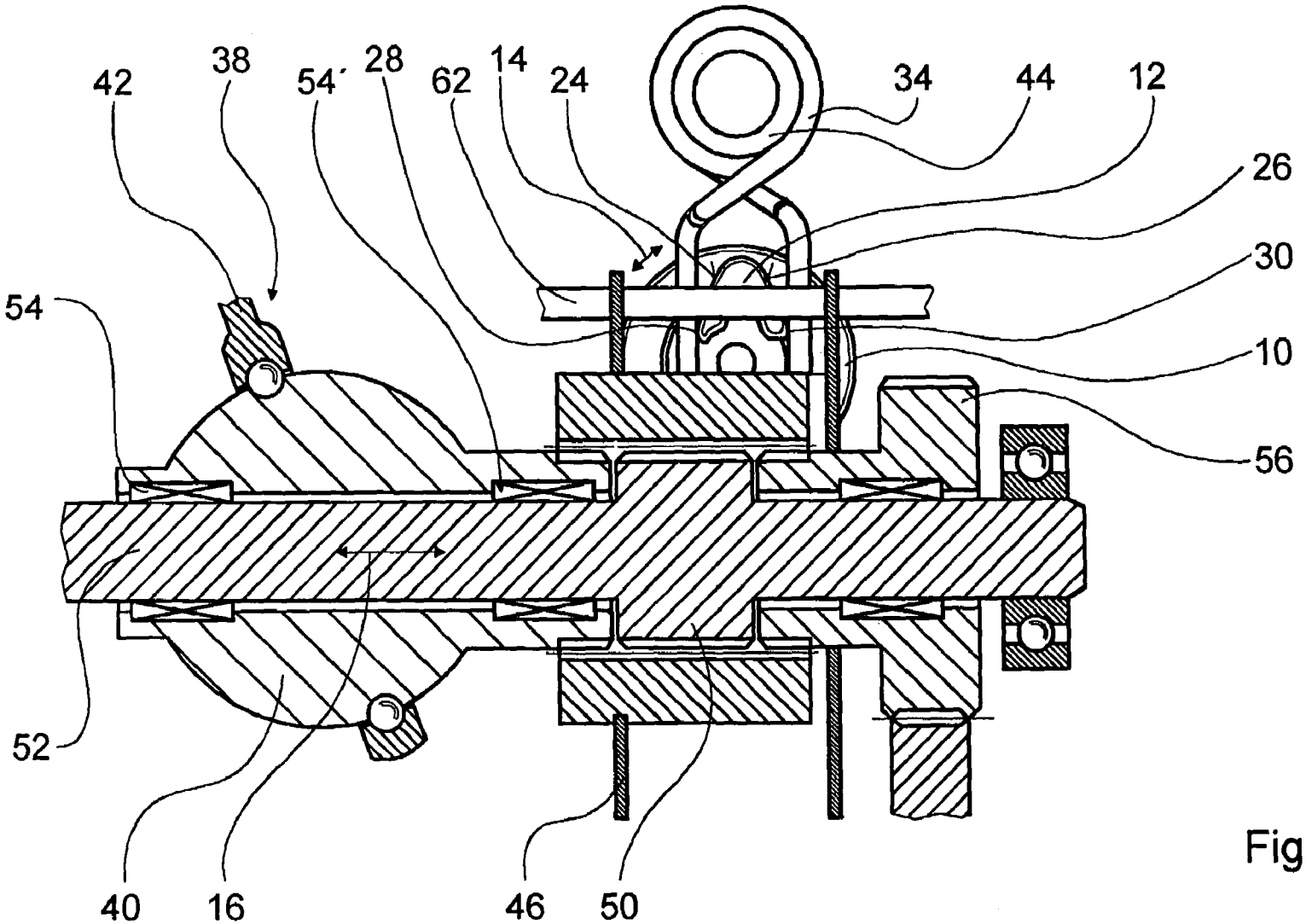
FIG. 3 shows the switching device in FIG. 2, in a sectional illustration.
Figure 4:
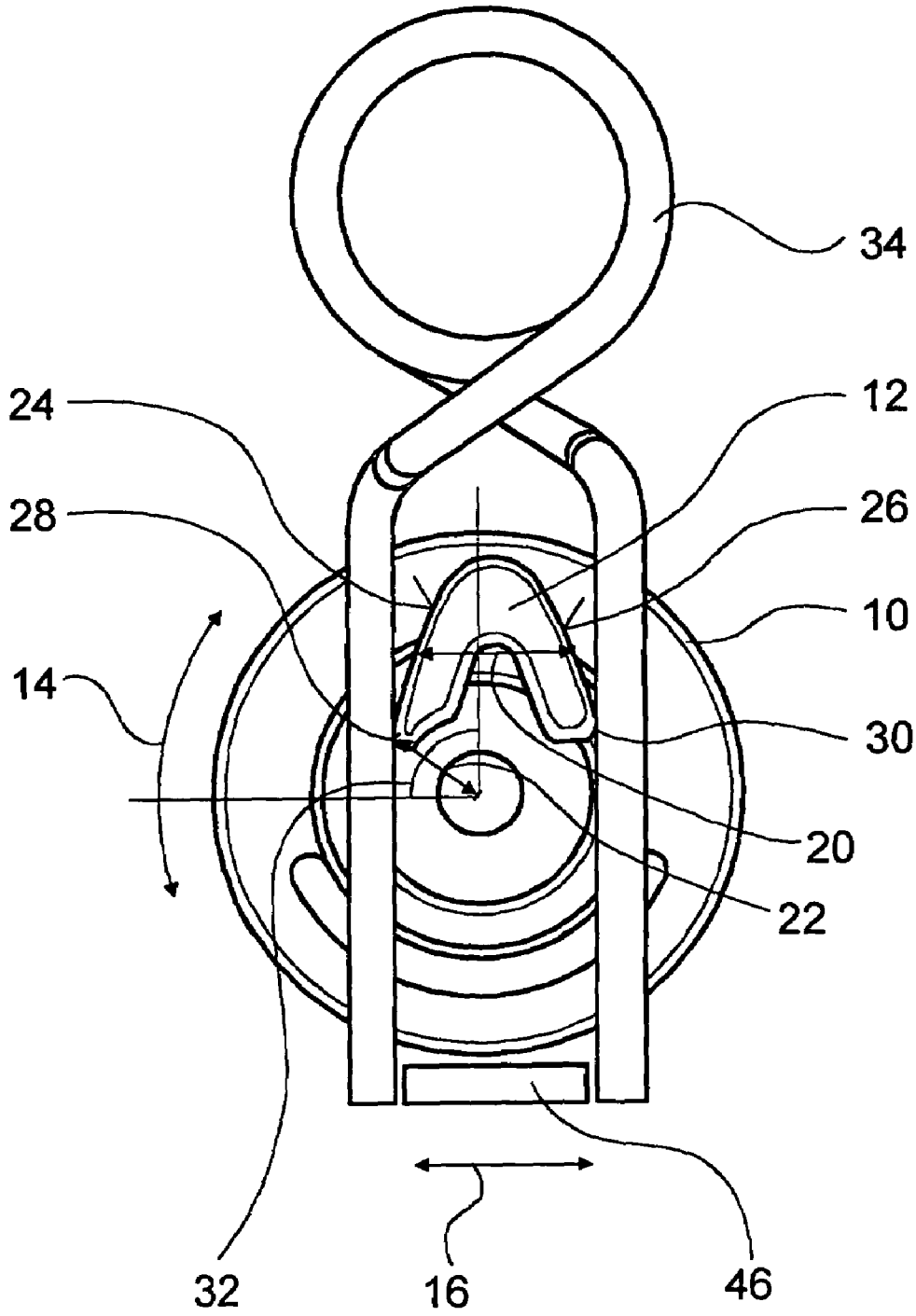
FIG. 4 shows a shift spring and an operating element of the switching device in FIGS. 2 and 3.

During a translatory displacement of from 0° to −90°, the roles of contact points 28, 30 and guide surfaces 24, 26 are exchanged, and the graph shown in FIG. 3 continues in an antisymmetrical manner.

Embodiments of the present invention are also feasible in which a shift spring is located on a switching piece capable of being axially displaced with a switching element, and is not connected with a housing of the hand-held power tool.

REFERENCE NUMERALS

| | |
|---|---|
| 10 | Operating element |
| 12 | Eccentric element |
| 14 | Rotational displacement |
| 16 | Translatory displacement |
| 18 | Switching element |
| 20 | Cross-sectional dimensions |
| 22 | Eccentricity |
| 24 | Guide surface |
| 26 | Guide surface |
| 28 | Contact point |
| 30 | Contact point |
| 32 | Angle of rotation |
| 34 | Shift spring |
| 36 | Tool fitting |
| 38 | Striking mechanism |
| 40 | Wobble bearing |
| 42 | Wobble finger |
| 44 | Bolt |
| 46 | Switching plate |
| 48 | Shift sleeve |
| 50 | Region |
| 52 | Drive shaft |

-continued

| | |
|---|---|
| 54 | Needle roller bearing |
| 56 | Gearwheel |
| 58 | Gearwheel |
| 60 | Switching range |
| 62 | Guide rod |

What is claimed is:

1. A switching device with a rotatably mounted operating element (10) and an eccentric element (12) for translating a rotational displacement (14) of the operating element (10) into a translatory displacement (16) of a switching element (18), wherein the switching element is in the form of a selector shaft of a hand-held power tool, wherein a shape of the eccentric element (12) differs significantly from that of a rod as well as a circular shape, wherein the eccentric element (12) has a guide surface (24, 26) provided to convert the rotational displacement (14) using a contact point (28, 30) that travels on the guide surface (24, 26) during the rotational displacement (14), wherein the guide surface (24) is substantially parabolic in shape, and wherein a vertex of the parabolic-shaped guide surface (24) points outwardly in a radial direction.

2. The switching device as recited in claim 1, wherein the eccentric element (12) includes at least two guide surfaces (24, 26).

3. The switching device as recited in claim 1, wherein an eccentricity (22) of the contact point (28) varies by at least 10% during a switching motion.

4. The switching device as recited in claim 3, wherein an eccentricity (22) of the contact point (28) varies by at least 50% during a switching motion.

5. The switching device as recited in claim 1, characterized by a two-legged shift spring (34) which, in at least one operating configuration, contacts the eccentric element (12) at two contact points (28, 30).

6. The switching device as recited in claim 5, wherein, in at least one operating configuration, the two-legged shift spring (34) is preloaded by the eccentric element (12).

7. A hand-held power tool comprising a switching device, wherein the switching device comprises a rotatably mounted operating element (10) and an eccentric element (12) for translating a rotational displacement (14) of the operating element (10) into a translatory displacement (16) of a switching element (18) in the form of a selector shaft of a hand-held power tool, and wherein a shape of the eccentric element (12) differs significantly from that of a rod as well as from a circular shape, wherein the eccentric element (12) has a guide surface (24, 26) provided to convert the rotational displacement (14) using a contact point (28, 30) that travels on the guide surface (24, 26) during the rotational displacement (14), wherein the guide surface (24) is substantially parabolic in shape, and wherein a vertex of the parabolic-shaped guide surface (24) points outwardly in a radial direction.

8. An eccentric element (12) for translating a rotational displacement (14) of an operating element (10) of a hand-held power tool into a translatory displacement (16) of a switching element (18) of the hand-held power tool, wherein a shape of the eccentric element (12) differs significantly from that of a rod as well as a circular shape, wherein the eccentric element (12) has a guide surface (24, 26) provided to convert the rotational displacement (814) using a contact point (28, 30) that travels on the guide surface (24, 26) during the rotational displacement (814), wherein the guide surface (24) is substantially parabolic in shape, and wherein a vertex of the parabolic-shaped guide surface (24) points outwardly in a radial direction.

* * * * *